United States Patent [19]

Mattingly et al.

[11] 4,392,490

[45] Jul. 12, 1983

[54] MULTIPLE OUTLET CONNECTING MEANS FOR SELF-CONTAINED POSITIVE PRESSURE OR DEMAND REGULATED BREATHING APPARATUS

[76] Inventors: Glen R. Mattingly, 950 E. Lockwood St.; Joseph A. Quintanares, 650 W. 1st Pl., both of Mesa, Ariz. 85201

[21] Appl. No.: 236,750

[22] Filed: Feb. 23, 1981

[51] Int. Cl.[3] ..... A62B 7/04

[52] U.S. Cl. ..... 128/202.27; 128/204.18; 128/205.25

[58] Field of Search ..... 128/201.23, 201.24, 128/201.28, 202.27, 204.18, 204.26, 205.12, 205.24, 205.25, 912; 285/7, 155, 156; 137/800, 883, 561 A

[56] References Cited

U.S. PATENT DOCUMENTS

| | | | |
|---|---|---|---|
| 3,238,943 | 3/1966 | Holley | 128/205.24 |
| 3,433,222 | 3/1969 | Pinto | 128/204.26 |
| 3,513,849 | 5/1970 | Vaillancourt et al. | 285/DIG. 2 |
| 3,781,941 | 1/1974 | MacFarland | 285/7 |
| 3,995,626 | 12/1976 | Pearce, Jr. | 128/205.24 |
| 4,328,798 | 5/1982 | Isaacson | 128/202.27 |

FOREIGN PATENT DOCUMENTS

| | | | |
|---|---|---|---|
| 591256 | 9/1977 | Switzerland | 128/202.27 |
| 1150875 | 5/1979 | United Kingdom | 128/912 |

OTHER PUBLICATIONS

Fire Engineering, Sep. 1980 issue, p. 115.

*Primary Examiner*—Henry J. Recla

*Attorney, Agent, or Firm*—Warren F. B. Lindsley

[57] ABSTRACT

A multiple outlet connecting means for self-contained positive pressure or demand regulated breathing apparatus which permits a distressed user low on air to safely and easily connect onto his buddy's air supply.

2 Claims, 5 Drawing Figures

MULTIPLE OUTLET CONNECTING MEANS FOR SELF-CONTAINED POSITIVE PRESSURE OR DEMAND REGULATED BREATHING APPARATUS

BACKGROUND OF THE INVENTION

This invention relates to positive pressure, self-contained or demand regulated breathing apparatus and, more particularly, to new and improved means for a distressed user of such equipment low on air to easily and safely connect his or her face mask to a buddy's air supply in emergency situations.

Positive pressure, self-contained breathing apparatus have become standard equipment for emergency operation personnel of most fire departments, mines, police and armed forces. Such equipment allows the user to carry his air supply with him when he enters an air contaminated atmosphere. The user's stay in the contaminated atmosphere is limited by the capacity of the air cylinder or cylinders he carries. Nevertheless, the time allotted the user is usually sufficient to provide time to finish search and rescue missions.

There are times, however, when the user has stayed too long in the air contaminated atmosphere and runs out of his air supply. In this situation, it is necessary for the distressed user of this equipment to immediately share a "buddy's" air supply.

Heretofore, the method of sharing a buddy's air supply involved the disconnection of the air hose of the distressed user from his regulator and then sticking the end of his hose under the face mask of his buddy's equipment. This system of sharing is dangerous since the buddy's face mask and in turn the distressed user's new supply may be easily contaminated since it is difficult to keep the contaminated atmosphere out of the sharing buddy's face mask, as hereinafter explained. Further, it is easy to pull out the end of the distressed user's hose from his buddy's face mask if he is not careful.

Another unsatisfactory method of buddy sharing is to share by sequentially shifting a common face mask from one user to the other while the non-user holds his breath.

Needless to say, these methods are unsatisfactory because of air contamination, heat, smoke and gases which can leak into the masks and air of the sharing buddies. Further, these contaminates can blind or even become deadly to both buddies in a matter of seconds.

PRIOR ART

Although no prior art is known, the claimed invention is readily applicable to positive pressure breathing apparatus manufactured by Scott Aviation as described in their advertisement on page 115 of the September, 1980 issue of *Fire Engineering* as well as other manufacturers of similar equipment.

SUMMARY OF THE INVENTION

In accordance with the invention claimed, a new and improved apparatus is provided which provides a means for a distressed user of a positive pressure, self-contained and/or demand breathing apparatus to quickly and safely share the air supply of a buddy using a similar breathing apparatus.

It is, therefore, one object of this invention to provide a new and improved self-contained breathing apparatus employing means for quickly and safely sharing its air supply with the user of a similar breathing apparatus.

Another object of this invention is to provide an improved connecting means for the known positive pressure or demand regulated self-contained breathing apparatus which makes it possible to share the controlled air supply of the apparatus with the distressed user of similar apparatus.

A further object of this invention is to provide a new and improved self-contained positive pressure and/or demand regulated breathing apparatus employing a snap-on or threaded connector means for readily receiving a companion connector part under emergency air contaminated conditions without contaminating the air supply flowing through the connector means.

These and other objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
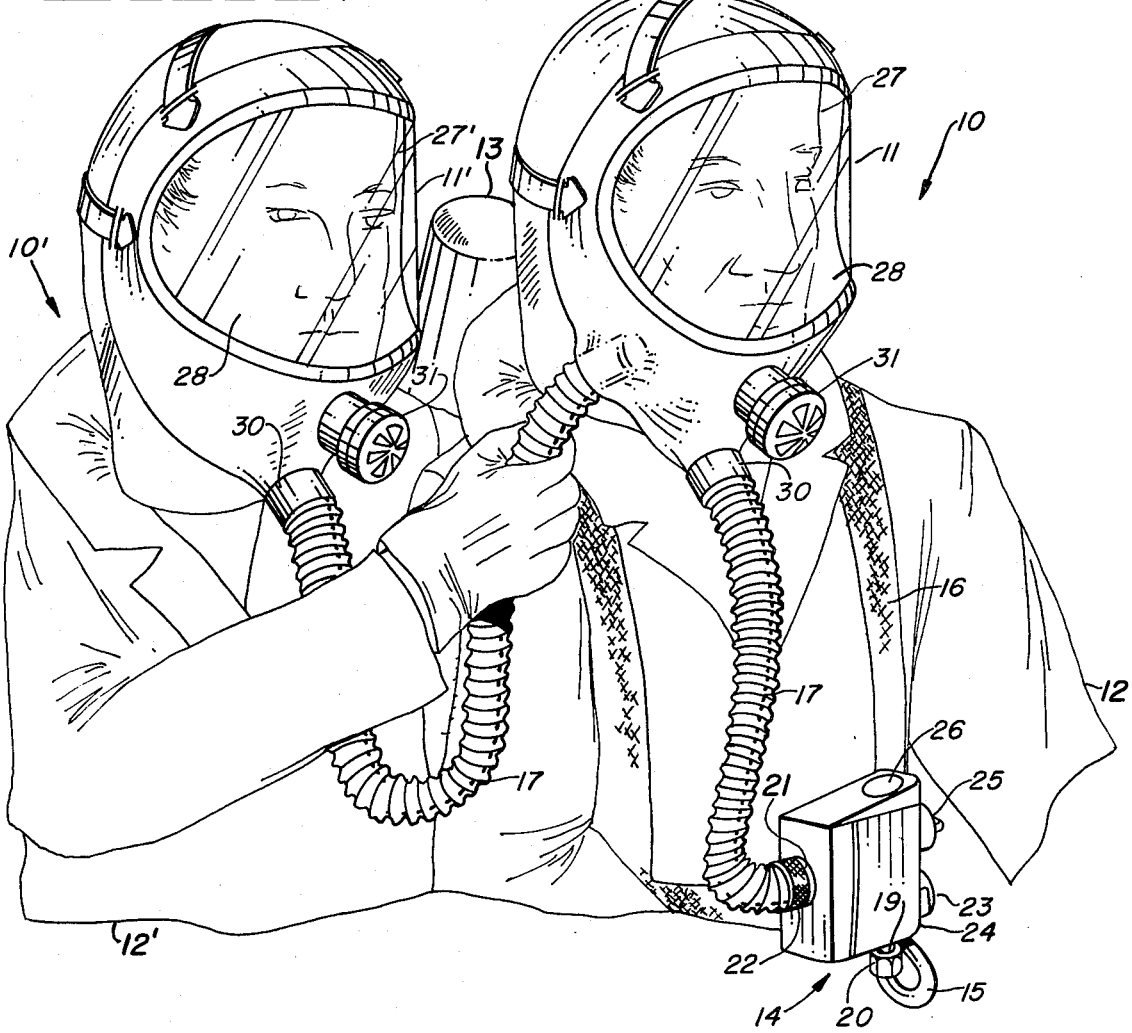
FIG. 1 (PRIOR ART)
FIG. 1 is a perspective view of two buddies using known positive pressure and/or demand regulated breathing apparatus wherein one buddy is sharing the air supply of another.
Figure 2:
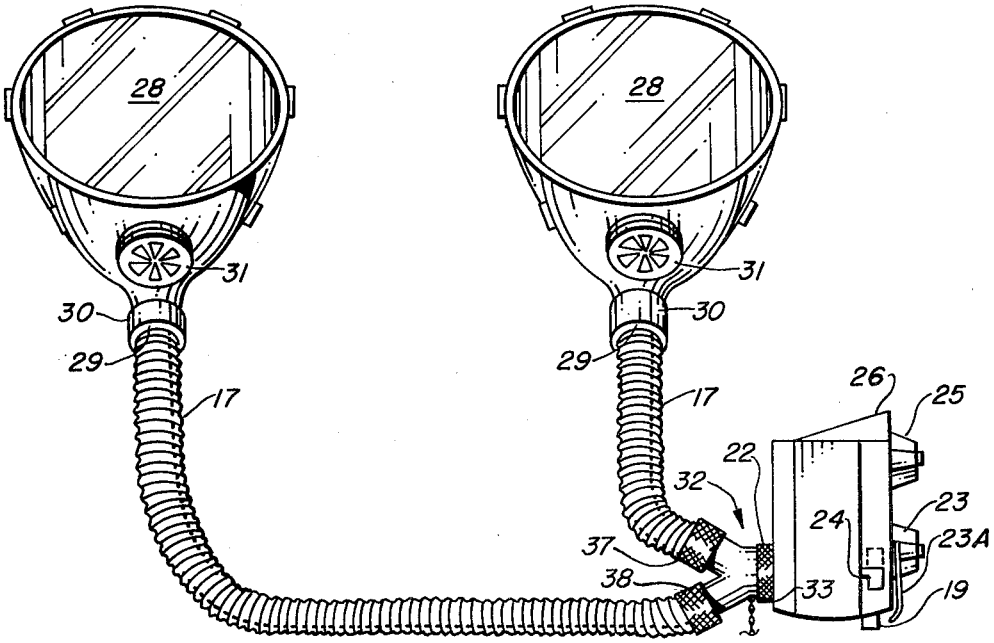
FIG. 2 is a perspective view of two face masks of positive pressure, self-contained breathing apparatus connected to a pressure regulator of one of the breathing apparatus and embodying the invention.

Referring more particularly to the drawings by characters of reference, FIG. 1 discloses a pair of positive pressure and/or demand regulated self-contained breathing apparatus 10 and 10', the face masks 11 and 11' of which are worn by human models 12 and 12'.

Each of the breathing apparatus 10 and 10' comprises an air cylinder or tank 13 connected to a pressure regulator 14 by means of a hose 15 which regulator selectively reduces the high pressure air supply of tank 13 to a value slightly above atmospheric pressure, or to a second value greater than atmospheric pressure or to a pressure regulated by the demand of a user. Each of the apparatus further comprises a face mask 11 and harness 16 which keeps the apparatus in a correct position relative to the user's body, a reinforced breathing tube or hose 17 for air delivery from the regulator 14 to the face mask 11 and an exhaust valve 31 connected to and forming a part of face mask 11.

The air tank 13 may comprise an aluminum shatterproof cylinder that contains about 60 cu. ft. of air compressed at a pressure of around 3000 pounds per square inch.

Harness 16 may be formed of a lightweight polypropylene material that is highly resistant to most environments and chemicals or of a suitable nylon or cotton webbing reinforced with steel bands. The task of the harness is not only to hold the air tank in place on the user's back but also to properly position the pressure regulator in a comfortable hand operable position in front of the user.

The pressure regulator's job is to provide a positive pressure continuous air supply or a given air supply upon demand of the user from tank 13 through hose 17 to mask 11 of the user 10. Generally, the pressure of the air supply is slightly above atmospheric pressure so as to prevent leakage of the atmosphere into the face mask of the user. This regulator comprises a box-like structure having an inlet port 19 which is connected by means of a coupler 20 to the high pressure cylinder or air tank 13 through hose 15. An outlet port 21 of the pressure regulator is connected by means of a coupler 22 through hose 17 to face mask 11.

The pressure regulator embodies a demand valve (not shown) which comprises a disk-like diaphragm having the pressure within the face mask on one side thereof. Upon a demand for air by the user involving inhaling of the air within the face mask, the pressure on one side of the diaphragm is reduced, thereby causing the diaphragm to deflect and the demand valve to pass air from tank 13 at a pressure slightly above atmosphere through hose 17 to inside of the face mask 11. This function is sequentially repeated each time the user inhales air in the face mask and exhales his breathing through the exhaust valve 31.

The pressure regulator 14 further comprises an on-off switch 23 normally spring biased toward its off position by a spring 23A which provides in its on position as air supply from tank 13 to the face mask 11 slightly above atmospheric pressure. A switch lever selectively movable from an off to an on position when in the on position stops the automatic flow of air under pressure slightly above atmosphere to face mask 11 and converts the regulator to a demand regulator controlled by the breathing action of the user.

An emergency bypass valve 25 is also provided which connects air under pressure at a higher pressure than normally supplied by the pressure regulator to the face mask thus enabling an air flushing action to occur in the face mask or an increased fresh air supply, if so needed.

A pressure gauge 26 built into the top of the regulator in viewing sight of the user provides a marked plate and dial indicator showing the supply content of the air tank 13 connected thereto.

In addition, the pressure regulator has a built-in automatic alarm (not shown) which rings and vibrates to warn the user of his diminishing air supply, usually enough when the alarm rings for only three to five minutes of normal use.

The face piece or mask 11 comprises a mask like structure formed of resilient material, such as rubber, which fits on the top of the head 27, over the face and under the chin of the user, as shown on models 10, 10' in FIG. 1 of the drawings.

The front of the face mask is provided with a clear safety lens or plate 28. The body of the face masks provides an inlet port 29 and connector 30 for fastening the outlet port of hose 17 thereto and an exhaust valve 31 which is pressure compensated to provide minimum exhalation resistance, all well known in the art.

When using this type of equipment, as illustrated in FIG. 1, a distressed user 10' out of air must share his buddy's supply if he is to survive. The present way this is accomplished other than the unsatisfactory procedure of alternating the use of the face mask of the air sufficient user, model 10' must disconnect the end of his tube 17 from his pressure regulator 14 and stick its free end underneath the cheekbone and into the air atmosphere inside of the face mask 11 of his buddy's equipment, as shown in FIG. 1. This method, although better than the alternating of the face mask mentioned above, still is unsatisfactory because contaminents, including heat, smoke and harmful gases, can leak from around the hose of the distressed user at the point it enters his buddy's equipment. Such contaminents from the atmosphere leaking into the face mask of the sharing buddy can blind or even become deadly to both users in a matter of seconds. This method of buddy breathing also limits the user of their arms in getting out of the emergency situation because of the need to hold the free end of the tube of the distressed user in place. Unexpected movement can cause the hose or tube to be pulled out of the face mask of the sharing buddy and then the air supply is lost to the distressed user. Further, this method is uncomfortable and awkward to implement.

In accordance with the invention claimed, a new and improved connecting means is provided for self-contained pressure breathing apparatus which makes it possible for a distressed user of this type of equipment to quickly and safely connect onto his buddy's air supply of similar equipment without the possibility of air contamination.

Figure 3:
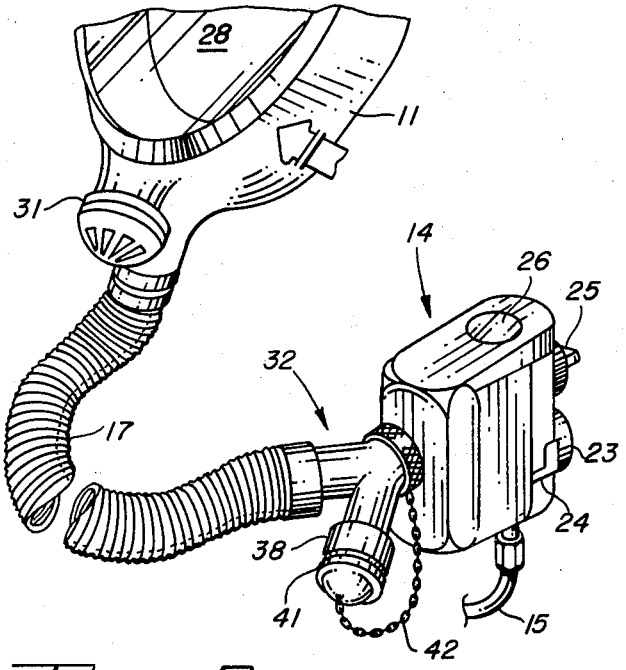
FIG. 3 is a perspective view of the mask and pressure regulator of a single breathing apparatus employing the capped air sharing connecting means.
Figure 4:
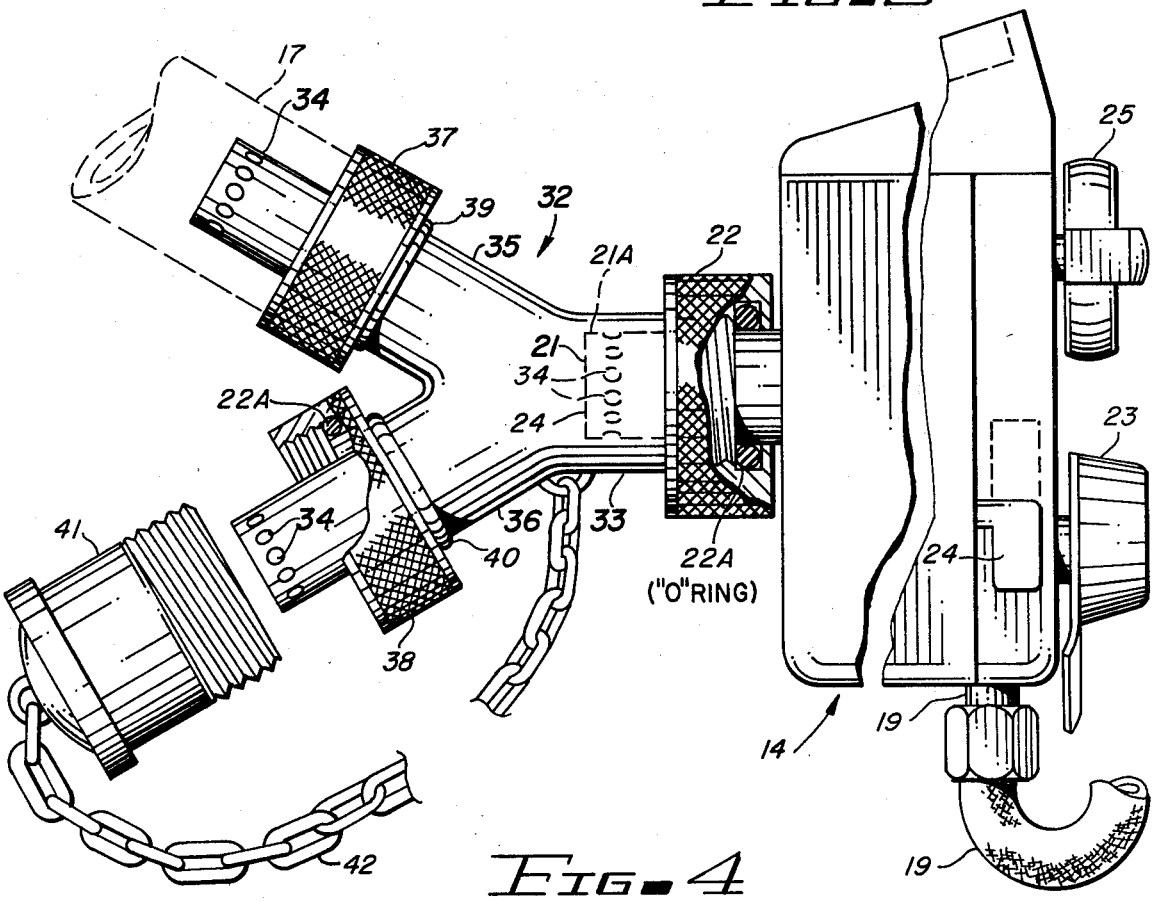
FIG. 4 is an enlarged partial exploded view of the cap being removed from the connecting means shown in FIG. 3 for receiving a companion mating part of a face mask of a similar breathing apparatus.

This connecting means comprises a Y-shaped coupling 32, the leg 33 of which is threadedly connected to coupler 22 of regulator 14, as shown in FIGS. 3 and 4. The outlet port 21 of pressure regulator 14 is provided with a plurality of apertures 34 extending through and around the periphery of a cylinder or tubing 21A which apertures permit a free flow of air under pressure from tank 13 through the coupling during a connecting and disconnecting operation of the coupler 22 and also prevents a user from stopping this air movement by placing his hands over the outlet port 21. The free ends of legs 35 and 36 of coupling 32 are also provided with a plurality of apertures 34 extending through and around the periphery of their ends for the same purpose.

Coupling 22 comprises a rotating sleeve fixedly mounted around outlet port 21 for threadedly connecting to leg 33 of coupling 32 in an airtight manner by means of an O-ring 22A and biasing spring (not shown). Similar couplings 37 and 38 are mounted around the free ends of legs 35 and 36 of coupling 32 seating against similar O-rings and flanges 39 and 40, respectively.

Coupling 37 is arranged to threadedly connect to hose 17 in the same manner that hose 17 connects to coupler 22.

The free end of leg 36 of coupling 32 is normally covered by a cap or plug 41 threadedly connected thereto in the same manner that hose 17 connects to coupling 37 and it is kept from getting lost by a chain 42 interconnecting plug 41 and coupling 32 in the manner shown.

When a distressed user of this type of breathing apparatus needs to connect to his buddy's air supply, it is merely necessary for the distressed user to remove the connecting end of his hose 17 from his pressure regulator and after removing cap 41 from his buddy's regulator 14 connecting the free end of his hose 17 thereto in the usual manner all in the matter of a few seconds.

This can be done with ease, safety and relatively no inconvenience to either user of this type of positive pressure breathing apparatus.

Figure 5:
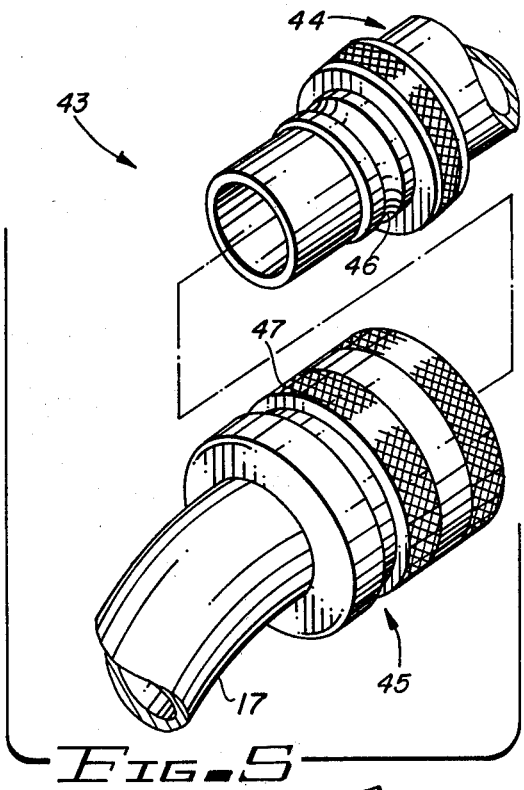
FIG. 5 is an exploded enlarged perspective view of a modification of the face mask hose connecting parts of the structure shown in FIGS. 1–4.

FIG. 5 illustrates a known quick connect and disconnect coupler 43, the parts 44 and 45 of which may be used in place of the coupler parts shown in FIGS. 1–4 for connecting hose 17 to the outlet port 21 of pressure regulator 14 or hose 17 to leg 35 of coupling 32.

Part 44 of coupler 43 comprises a male connector which is threadedly mounted over outlet port 21 and having a groove 46 arranged around its periphery at a short distance spaced from the end thereof.

The female part 45 of coupler 43 which is suitably clamped to the end of hose 17 is provided with a ball bearing race (not shown) which when clamped over part 44 places the inner track of the ball bearing of the race in groove 46. A collar 47 on part 45 is spring biased to a position over race 47 mounted within part 45.

This type of connection further aids in quickly connecting and disconnecting a distressed user of this type of breathing apparatus to and from his buddy's air supply with little or no damage of contamination.

It will now be recognized that a significant improvement is provided in self-contained positive pressure and/or demand breathing apparatus over the prior art in accordance with the stated objects of the invention, and while but two embodiments of the invention have been illustrated and described, it will be apparent to those skilled in the art that various changes and modifications may be made therein without departing from the spirit of the invention or from the scope of the appended claims.

What is claimed is:

1. A control means for a self-contained breathing apparatus comprising:

means for receiving air under pressure from a pressure regulator, said means comprising an inlet port and at least two outlet ports, said inlet port comprising means for direct connection with an outlet port of said regulator, each of said outlet ports of said control means comprising a connector means for connection with the end of a hose provided for transmitting air under pressure to a face mask of the breathing apparatus, a detachably mounted plug removably connected to said connector means of one of said outlet ports of said control means for selectively closing the associated outlet port, said outlet ports each comprising a cylinder extending outwardly thereof, a plurality of holes extending around and through the periphery of each of the cylinders, and said connector means being mounted on said control means at a point spaced from the end of the associated cylinder.

2. A self-contained positive pressure breathing apparatus comprising:

a tank containing air under pressure, a harness fastened to said tank for mounting said tank on the back of a user, a pressure regulator comprising inlet and outlet ports mounted on said harness for positioning in front of the user, a first hose means for connecting said inlet port of said regulator to said tank, a second hose means, a face mask for mounting on the head and over the face of a user, means for connecting one end of said second hose means to said face mask, control means comprising an inlet port and at least two outlet ports, means for connecting said inlet port of said control means directly to said outlet port of said regulator, a connector means for selectively connecting each of said outlet ports of said control means to the other end of said second hose means for transmitting air under pressure from said regulator to said face mask of the breathing apparatus, a detachably mounted plug removably connected to said connector means of one of said outlet ports of said control means for selectively closing the associated outlet port, an exhaust valve mounted in said face mask for exhausting the exhaled breath of the user, and said outlet ports each comprise a cylinder extending outwardly thereof, a plurality of holes extending around and through the periphery of said cylinder, and said connector means mounted on said control means at a point spaced from the end of said cylinder.

* * * * *